United States Patent [19]

Rosa et al.

[11] 4,149,326

[45] Apr. 17, 1979

[54] MACHINE FOR DIGGING A TRENCH BENEATH A SUBMERGED PIPELINE

[75] Inventors: Giovanni Rosa; Guido Casagrande; Niso Predonzani, all of San Donato Milanese; Umberto Giovannini, Corsico; Giuseppe Bonvini, Camerano; Fernando Po, Milan, all of Italy

[73] Assignee: Saipem S.p.A., Italy

[21] Appl. No.: 857,184

[22] Filed: Dec. 2, 1977

Related U.S. Application Data

[63] Continuation of Ser. No. 657,275, Feb. 11, 1976, abandoned.

[30] Foreign Application Priority Data

Feb. 11, 1975 [IT] Italy ..... 20072 A/75

[51] Int. Cl.[2] ..... E02F 5/02

[52] U.S. Cl. ..... 405/160; 37/195; 37/64; 405/162

[58] Field of Search ..... 61/72.4; 37/64–67, 37/195

[56] References Cited

U.S. PATENT DOCUMENTS

| | | | |
|---|---|---|---|
| 3,004,392 | 10/1961 | Symmank | 61/72.4 |
| 3,338,059 | 8/1967 | Tittle | 61/72.4 |
| 3,434,297 | 3/1969 | Gretter et al. | 61/72.4 |
| 3,583,170 | 6/1971 | De Vries | 61/72.4 |
| 3,717,003 | 2/1973 | Bates, Jr. et al. | 61/72.4 |
| 3,732,701 | 5/1973 | Lynch | 37/65 X |
| 3,857,250 | 12/1974 | Di Tella et al. | 61/72.4 |
| 3,926,003 | 12/1975 | Norman | 61/72.4 |

FOREIGN PATENT DOCUMENTS

| | | | |
|---|---|---|---|
| 2029813 | 10/1971 | Fed. Rep. of Germany | 61/72.4 |
| 1286521 | 8/1972 | United Kingdom | 61/72.4 |

*Primary Examiner*—Clifford D. Crowder

*Attorney, Agent, or Firm*—Morgan, Finnegan, Pine, Foley & Lee

[57] ABSTRACT

An apparatus for digging a trench beneath a pipeline laid on the bottom of sea or a water body, in which a clamp arrangement is split into a wider sector portion and a narrower sector portion which, as they are united under the control of a driving mechanism, embrace the pipeline and allow a set of digging discs to excavate the ground beneath the pipeline. Provisions are made to remove the debris on completion of digging. The apparatus is driven along the pipeline and means are provided to maintain both the correct vertical trim of the entire apparatus and the correct position of the pipeline track.

5 Claims, 29 Drawing Figures

MACHINE FOR DIGGING A TRENCH BENEATH A SUBMERGED PIPELINE

This is a continuation of application Ser. No. 657,275, filed Feb. 11, 1976, now abandoned.

This invention relates to an apparatus called a counterrotating disc digger which provides a stabilized efficient system for digging a pipeline trench by the rotation of bit-carrying discs having an orbital motion about the pipeline to be buried in the trench. The apparatus functions is a single, expeditious and economical manner to perform the operation of digging a trench beneath a pipeline laid on the sea bottom which may be of a rocky nature and located at great depths.

It is known that the digging of a subsea trench is necessary for protecting a pipeline laid on the sea bottom from crushing and breakage which may be caused by the anchors of dragging ships along the bottom.

It is necessary, however, that the digging operation proceed with a wide margin of safety in steps which are required for its performance and with the necessary regularity to prevent costly wasted time. In addition, the means employed for carrying out the digging must be capable of functioning with a succession of many different kinds of sea bottom configurations and structures.

Due to the above, it is necessary that the apparatus be capable of providing a plurality of operations, with simplicity, rapidity and safety of use.

Now, the machines as known in the present art for digging a trench beneath a submerged pipeline all have defects of both a practical, economical and working nature.

As a matter of fact, several kinds of conventional machines are designed for the operation of digging a trench with tools which have a multiplicity of blades ganged in a basket-like arrangement at the end of motor shafts, mounted on carrying frames, which can be rotated and inclined through a certain angle in order to carry out the digging about the submerged pipeline.

The blade-baskets are not suitable for digging in sound sea bottoms and their axles require, due to their bulk, the solution of various difficulties in the adjustment maneuvers necessitated by the various configurations of the sea bottom.

On the other hand, conventional tools for digging and other tools shaped in a roughly conical outline and equipped with blades or points at the ends of motive shafts, are mounted on several kinds of frames, which are sometimes fitted with crawler tracks. The frames are driven by bulky and inconvenient engines in the various operations so that the digging operation is further slowed down.

In addition, the apparatus for guiding the machine intended for digging, should it be of an electronic type, is supported by an arm which is integral with the frame or the tracked vehicle which carries the digging implementation. If it is of the mechanical, wheeled type, the apparatus is inserted between the frame or the tracked means, and the pipeline. In both cases the apparatus is inadequately reliable in order to obtain a secure advance along the longitudinal axis of the laid pipeline.

Other known machines are subjected to various unbalances, mainly in their transversal trim due to the occurrence of subsea streams which are not adequately countered by applying on the supporting frames load and air reservoirs. Moreover, on account of the variable configuration of the sea bottom, on which, inter alia, rocky peaks may be scattered, the application of mechanical jutting arms might even obstruct the motion of the digging means.

Still further, the advance systems known in the present state of the art, if they are based on the action of motor-driven tracks, is limited to sound sea bottoms which are also planar. Muddy bottoms or the rocky bottoms prevent the crawler track from carrying out the regular dragging action. Should the advance system be based, instead, on the dragging action imparted by a trailing cable pulled by a ship on the sea surface, it is subject to all the uncertainties in guiding which are due to the connection through signals and the variation of the cable drag between the ship on the sea surface and the digging apparatus which is operating on the sea bottom.

An object of the present invention is to avoid the drawbacks of the prior art while providing an apparatus for digging a trench beneath a submerged pipeline. The apparatus is driven by either having an independent power source or receiving power through a cable from surface ships. The apparatus follows accurately the path of the digging to be carried out alongside and beneath the laid tubing. The disc-like supporting members for the bits which crush and disaggregate the different sea bottom surfaces, completely surround the pipeline itself with the latter preventing even the slightest deflection. The machine is further stabilized so as to readily acquire with facility its transversal trim which may possibly have varied during the trenching advance. The machine is also equipped with two digging mechanisms which are located at the ends of two carrier-axes and are each constructed with a hood and a mantle supporting a disc which is rotated, either centrally or eccentrically, about the laid pipeline and having cone or roller bits. The bits are equipped with teeth which are adapted to cut through any kind of minerals including rocks which make up the sea bottom as the machine advances. The apparatus is designed to perform the digging operation indifferently to the direction of advance as it moves parallel to the longitudinal axis of the laid pipeline. The rotation of the bit-carrying disc placed at either end is aided, in order to complete the digging, by the rotation in the opposite direction of the outer bit-carrying disc placed at the opposite end and the rotation of which in the opposite direction additionally cooperates towards stabilizing the apparatus in a plane transverse to the longitudinal axis of the laid pipeline.

On the other hand, with the trench digging apparatus of this invention, the advance of the apparatus in either direction occurs simultaneously with the stable operation. The apparatus is initially moved forward, by the thrust of two first hydraulic jacks which rest on one side of the carrying axles of the machine and on the other side on a sliding bridge with the intermediary of two sliders on the carrying axles. The bridge supports by means of a guideway a first set of jaws, to be called clamps, placed on both the sides and the top of the pipeline and tightened by two hydraulic jacks and a torsion bar about the pipeline and a second set of clamps having been released beforehand from the pipeline. As soon as the first two jacks have finished, by being ejected outwards, moving the two carrying axles, and consequently also the rotary discs, in the direction of advance of the digging by resting on the first set of clamps tightened about the pipeline, the second set of clamps is tightened about the pipeline. Immediately thereafter the first set of clamps is clear of the pipeline and the first thrust jacks begin the recovery stage. Then the second set of clamps which is tightened about the pipeline, through the action of a hydraulic jack placed in the plane transverse to the pipeline and driven by a mechanism governed by a sensor which measures the deflection of the digging apparatus from its normal vertical position, imposes, with a rotary movement transverse to the longtiudinal axis of the pipeline, to the bridge, connected to the carrying axes and to the bit-carrying discs, a rotation on a guide. The guide is connected to the clamps which are tightened about the pipeline, until said bridge is arranged again, should it be unbalanced, in a normal vertical position of advance. The apparatus for digging a trench according to the present invention thus reacquires its normal trim in a plane transverse to the related pipeline during the entire advance along the path of the laid pipeline and even when said trim has possibly undergone a change.

When the direction of advance of the machine according to this invention is reversed, the advance of the machine is carried out by the thrust of two additional hydraulic jacks which are active on one side on the carrying axles of the machine and, on the other side, through the bridge, the sliders and the guide on the second set of clamps tightened onto the pipeline. Previously, these clamps functioned in the forward direction by being tightened about the pipeline through a transverse jack, for stabilizing purpose whereas they are now intended only for the operation of advancing the pipeline in the direction opposite to the one described hereinbefore. The first set of clamps operate now, by being tightened around the pipeline with their transverse jack, only for the purpose of stabilizing the machine.

Summing up, the machine or apparatus for digging a trench according to the present invention comprises two carrying axles at the ends of which there are arranged the mechanisms which support the discs equipped with the bits for digging, rotatable about the laid pipeline. Each axle is connected to the other by two bridge-like frames each of which, at its ends, is fastened to the axles by two pins which can be rotated about the relative seats placed on two sliders each of which is incorporated in the respective carrying axle.

The bridge pins, during the advance of the machine along the laid pipeline, correct the tightening of the clamps on the pipeline which has been laid whenever the pipeline follows a non-rectilinear path, the result being a misalignment between the pipeline and the machine in the longitudinal direction.

According to another feature of the invention, at each end of the apparatus there are fastened to the carrying axles metal casings, which are called fixed hoods, in the form of an inverted U, which partially surround the pipeline as the machine goes astride the pipeline and the ends of which are partially closed by shields which tend to prevent the entrance of digging debris between the hood and the pipe. This operation is facilitated by a set of ejectors which surround the shields, the latter being equipped with wheels which accompany the longitudinal motion of the machine as the latter is pushed by the jacks along the pipeline during the sea bottom digging operation. On every fixed hood, through rotation guides, an open crown is mounted, which is called the large sector of the mantle, with an initial sectional outline in the form of an inverted U. Once the machine has gone astride the pipeline and makes half a revolution through hydraulic motive means, arranged on the fixed hood and equipped with a pin meshing with a stop arranged on the larger sector of the mantle, and now exhibits a cross sectional outline in the shape of a straight U which is immediately completed, by the thrust of a jack longitudinally on the fixed hood, by a narrower mantle sector sliding on dovetail guides arranged on the fixed hood. By so doing, about the fixed hood, there is originated, with an inverted U cross-sectional outline, a mantle encompassing a complete circle which remains then stationary during the advance of the machine in digging, and which supports in its turn a disc, rotatable thereon, encompassing a complete circle, which was initially split up before the thrust of the jack placed longitudinally on the fixed hood, into a larger and a narrower sector which were fastened respectively on the larger and the narrower sectors of the supporting mantle.

The bit-carrying disc thus formed rotates during the advance of the machine on dovetail guides formed circumferentially on the supporting mantle and receives its drive from hydraulic motive means arranged on the narrower sector of the supporting mantle.

According to an alternative embodiment of the invention, the fixed mantle and the movable disc can be formed, each, by two open half-crowns hinged at the top and which can be closed about the fixed hood, thus providing two complete crowns, one fixed and the overlying one movable, when the machine is mounted astride the pipeline which has been laid.

According to a further feature of the invention, one of the two groups of clamps, tightened about the pipeline, serves as a thrust base for the jack which imparts the motion, through the carrying axles, to the digging machine, and the other group, free during the motion of the first and then tightened about the pipeline as the first, in its turn, has been opened on the pipeline, serves to restore, at every end of stroke of the thrust jack, the transversal trim of the machine which had possibly been tilted in the transversal plane of the pipeline. These functions are performed by the two sets of clamps when the digging machine is moved in one of the two possible directions of motion along the laid pipline. When the machine, on completion of the first digging pass, inverts its direction of motion to start the second digging pass, the functions of the clamps are reversed. Each set of clamps designed for providing a reliable tightening along with the best distribution of forces about the pipes so that the outer lining of the pipes does not suffer any damage, by four clamps arranged pairwise beneath each carrying axle.

According to another feature of the invention, the digging of a trench is generally carried out in several passes. A pass is made over the entire digging route beneath the pipes at a depth imposed by the thickness, in the direction of height, of the bit-carrying disc.

Another feature of the invention involves the clamp which is placed atop each clamp set arranged laterally under the center of the pipeline and which, as they are tightened, also develop a vertical component of force. The top clamps as pushed each by a torsion bar system, counteract the vertical component with a force and distribute the same over a wide surface of the lining of the laid pipeline so that the lining is not damaged in the slightest.

Other features of the invention involve half-bores, drilled on the outer circumference of the bit-carrying discs, which bores serve to carry the flow of debris resulting from the crushing of the sea bottom. The bores carry the debris towards the mouths of the suction pipes equipped with ejectors as disclosed in the Italian Pat. No. 946,582.

Also, shields are provided at the ends of the machine on bit carrying discs to protect the pipes from the digging debris. The invention further discloses mounting, on the periphery of the rotary discs, a set of bits of conical shape equipped with teeth and internally and staggered with respect to the former, another set of bits in a conical arrangement. The second set of bits is also equipped with teeth and together the sets define an optimum digging cross-sectional outline from a time and efficiency standpoint. The mounting of the apparatus of this invention astride the pipeline and the further operations involving the mantles and the bit-carrying discs can be carried out by directly laying the apparatus, at the outset, on the pipeline with the trim maintained by a compressed air reservoir having balancing compartments and arranged atop the apparatus. The suction pipes, draw in the sludge and sand which form the material of the sea bottom providing the space which is required for setting up the mantle and the complete discs. Alternatively the pipeline may be lifted from the sea bottom by means of a pincer mechanism as already disclosed in the Italian Pat. No. 983,196 and the apparatus for the digging operation may be mounted on the pipeline. The mantles and the bit-carrying discs are then set up and the apparatus is advanced in the desired direction the bit-carrying discs rotating.

The invention is now better explained with reference to the accompanying drawings which are illustrative of a preferred embodiment as given by way of example only and without limitation since technical and constructional changes may be introduced in any case without departing from the scope of the present invention.

In the drawings:

FIGS. 1*a*, 1*b*, 2*a*, 2*b*, 3*a*, 3*b* show the mounting of the digging apparatus diagrammatically which is shown in FIG. 4 in top view.

Figure 15:
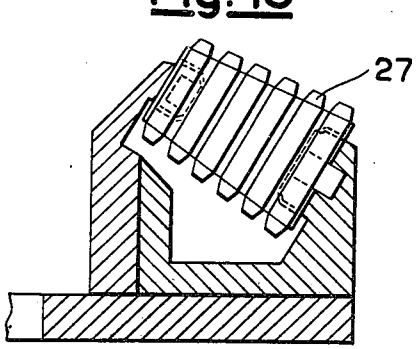
Figure 14:
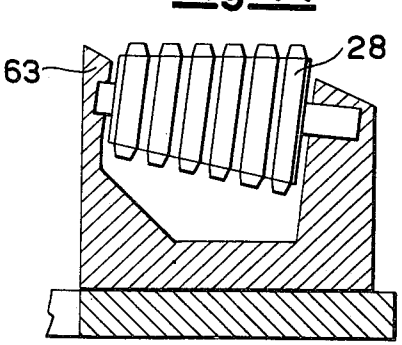

FIGS. 14 and 15, which are cross-sectional views, show the two types of bits to be mounted on the disc.

Figure 16:
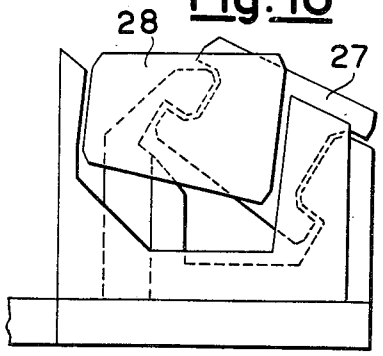

FIG. 16 is a diagrammatical showing of the outline of the digging bits.

Figure 17:
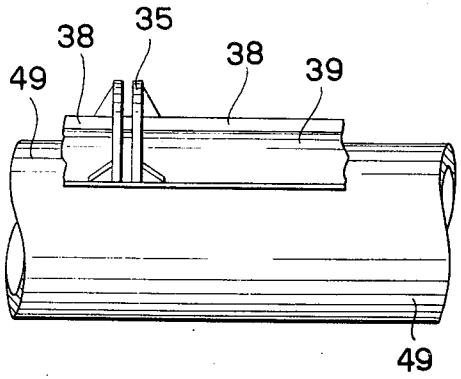

FIG. 17 is a side view of a portion of a top clamp to which a guide is welded.

Figure 18:
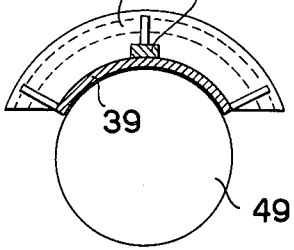

FIG. 18 is a front view of the guide.

Figure 19:
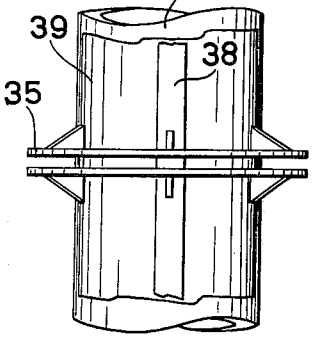

FIG. 19 shows in top plan view, a portion of the top clamp and the guide.

Figure 20:
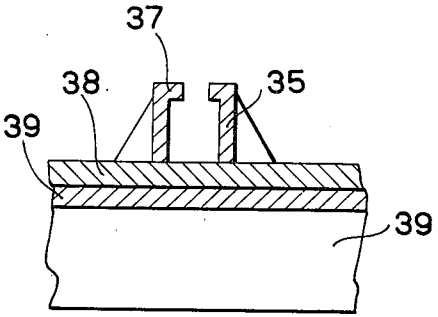

FIG. 20 is a longitudinal cross-sectional view of the top clamp and the guide.

Figure 21:
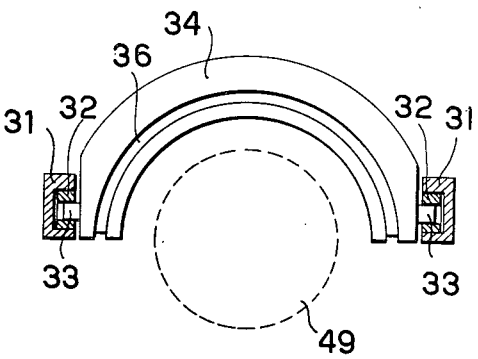

FIG. 21 is a side view of one of the two bridges, pivoted on the two carrying axles.

Figure 22:
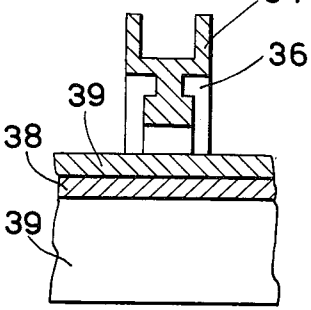

FIG. 22 shows a longitudinal cross-sectional view of a bridge.

Figure 23:
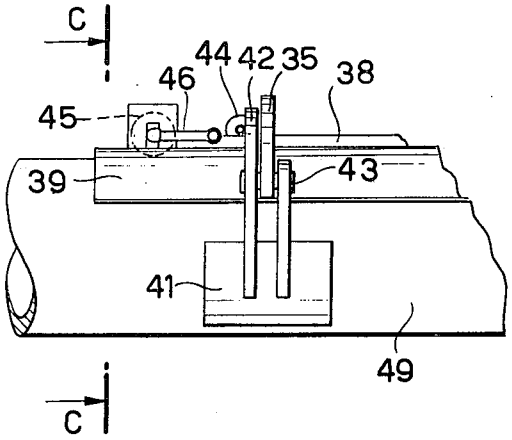

FIG. 23 is a side view of a portion of a top clamp and a side clamp.

Figure 24:
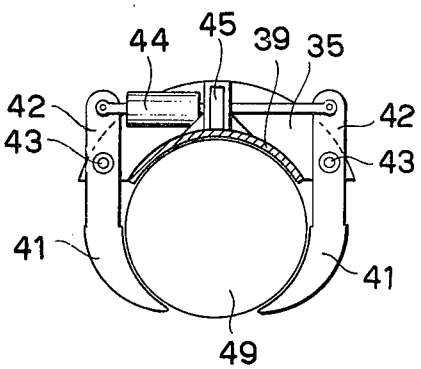

FIG. 24 is a cross-sectional view taken along the line C—C of FIG. 23 and shows the side clamp together with the clamp to which it is matched for tightening the machine on the pipeline, in front view.

Figure 26:
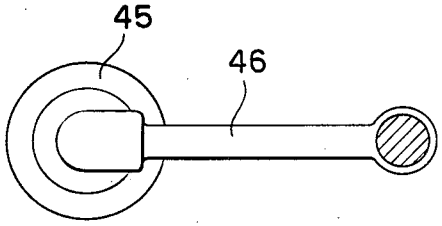
Figure 25:
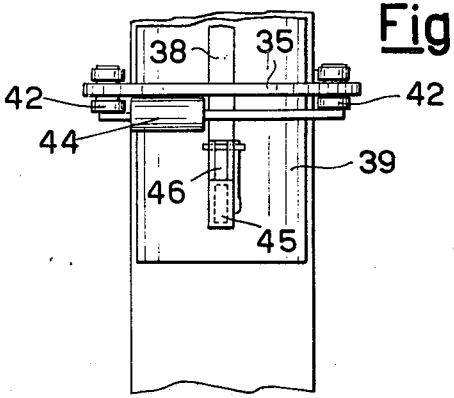

FIG. 25 shows from the top a portion of a top clamp and two side clamps, and FIG. 26 shows in side elevational view the torsion bar for lifting the top clamp.

Figures 1A, 1B, 2A, 2B, 3A, 3B, 4:
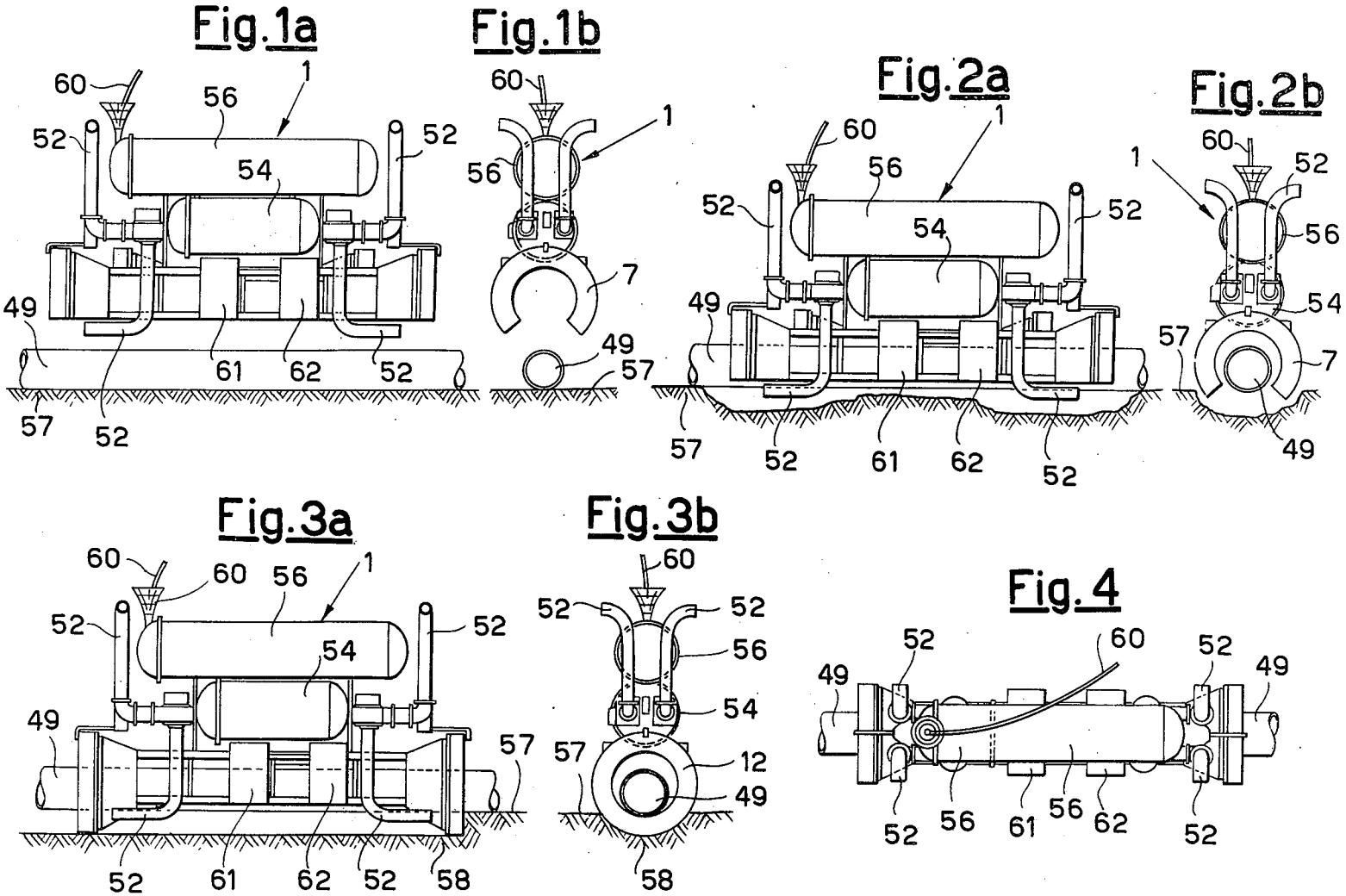

Referring now to FIGS. 1*a* to 3*b* at the outset, the digging apparatus 1, the trim of which is set by the floating reservoir 56, is about to be put astride the pipe 49 with the set of clamps 61 and 62 wide spread apart and the larger sector 7 of the bit-carrying disc is in the position of inverted U. Subsequently, once the apparatus 1 has been mounted on the pipe 49, the tubes 52 draw in the sea bottom 57, which may be either sandy or sludgy, in order to provide the space which is required for completing the bit-carrying disc 12 as shown in FIG. 3*b*. Once it has been set up, the disc 12 begins the digging of a trench 58 after having been set in motion by the hydraulic motive means driven by the electric motors located in the container 54. The motors receive their power from the feeding cables 60.

Figure 5:
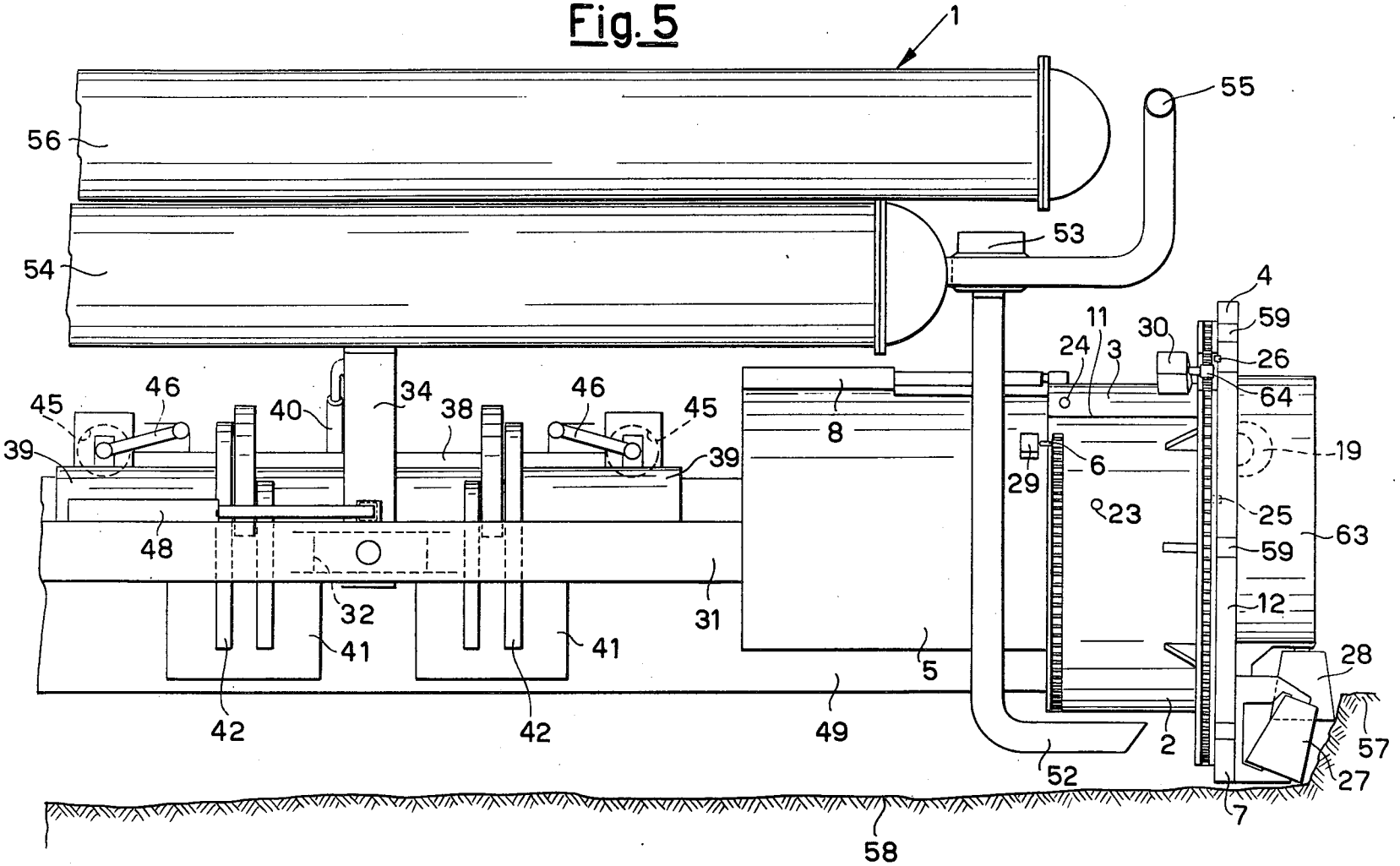
FIG. 5 is a side elevation of one half of the apparatus the other half being a mirror image of the former.

In FIG. 4, the cables 60 for feeding the electric motors come from a surface watercraft (not shown). In FIG. 5 the numeral 56 indicates the buoyancy reservoir which facilitates the stabilization of the apparatus 1 when the machine or apparatus is astride the pipeline 49 after having been lowered from a surface watercraft through a cable (not shown), and also during the advance of the machine along the pipeline. The electric motors for the hydraulic motive means are designed to actuate the jacks of the hydraulic motors and the jets from the ejectors of the machine are situated in the reservoir 54. The carrying axle 31, together with a corresponding axle 31 arranged on the opposite side of the pipeline 49 and not shown, connect at both ends the digging mechanisms and support on their central portion the mechanisms for the displacement and the stabilization of the apparatus 1.

Figure 6:
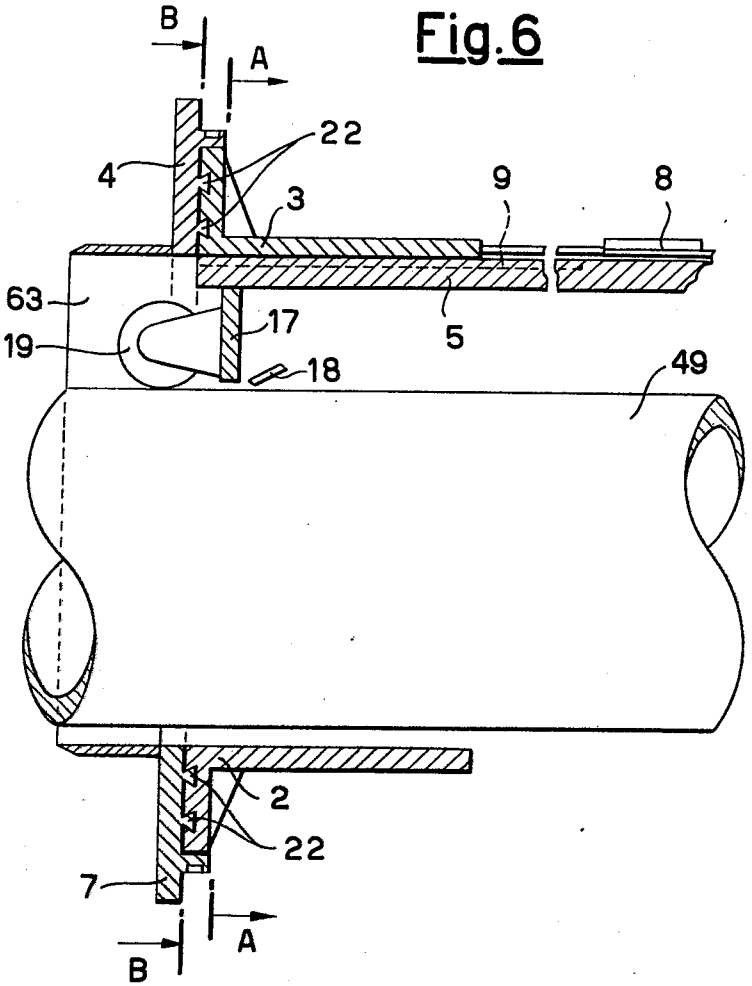
FIG. 6 shows in cross-sectional view the hood, the mantle and the disc on one end of the apparatus.
Figure 9:
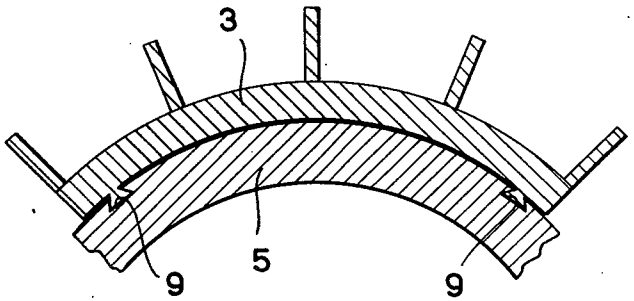
FIG. 9 is illustrative of a cross-sectional view along the line A—A of FIG. 6.

One of the two digging mechanisms, as shown in FIG. 5, comprises the fixed hood 5 which is welded to either end of the axles 31, has an inverted-U sectional shape and is affixed at the other end to the shield 17, as shown in FIG. 6. The shield 17 is equipped with a set of wheels 19 adapted to guide the apparatus 1 on the pipeline 49.

Figure 7:
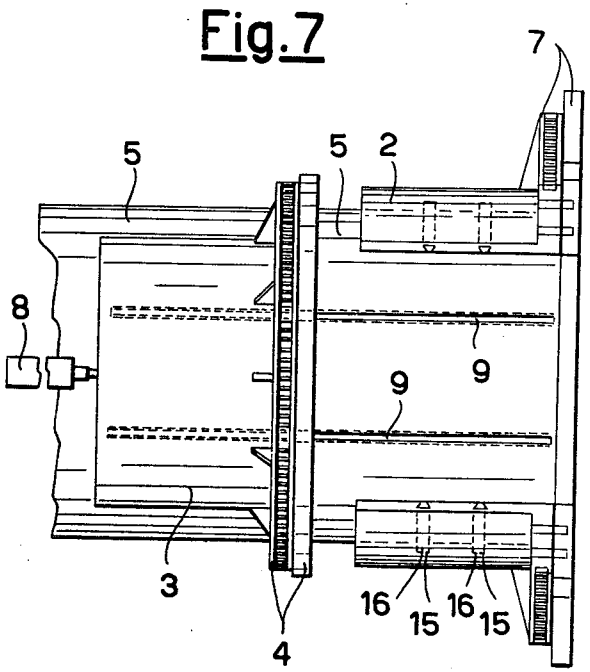
FIG. 7 is a top view of either end of the machine without the bits.

On the fixed hood 5, as shown in FIG. 7, there are arranged the two male guides 16 of dovetailed shape which enable the larger sector 2 of the mantle 11, through the two female guides 15 formed on the same sector, to be rotated by the hydraulic motor 29 of FIG. 5. The pinion 6 of the motor 29 is coupled to a ring gear integral with the larger section 2 of the mantle, from an initial position in inverted-U configuration adapted to mounting on the pipe 49, to a final position in the form of an upright U in which it is affixed through the pin 23 onto the fixed mantle 5.

Figure 10:
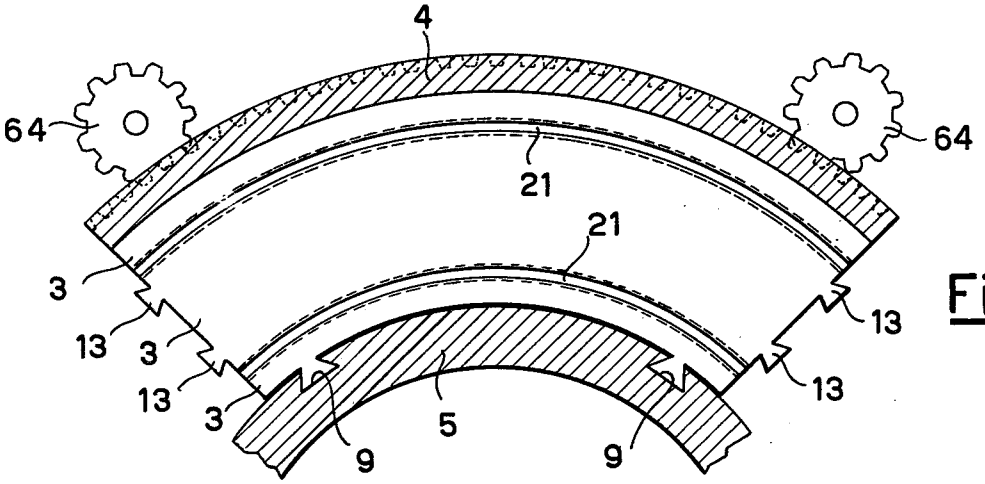
FIG. 10 is a cross-sectional view taken along the line B—B of FIG. 6.
Figure 13:
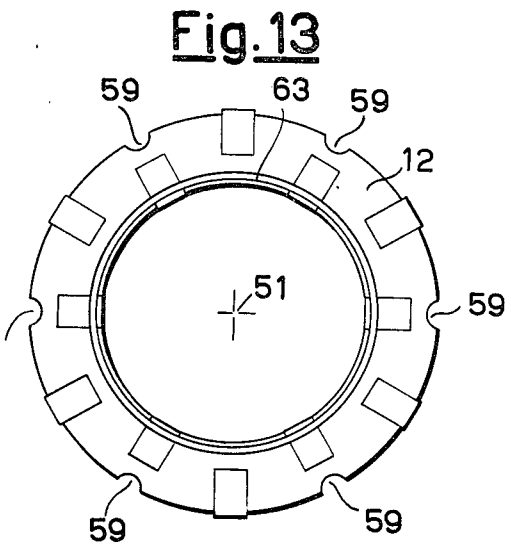
FIG. 13 shows the disc setup, in elevational view.
Figure 12:
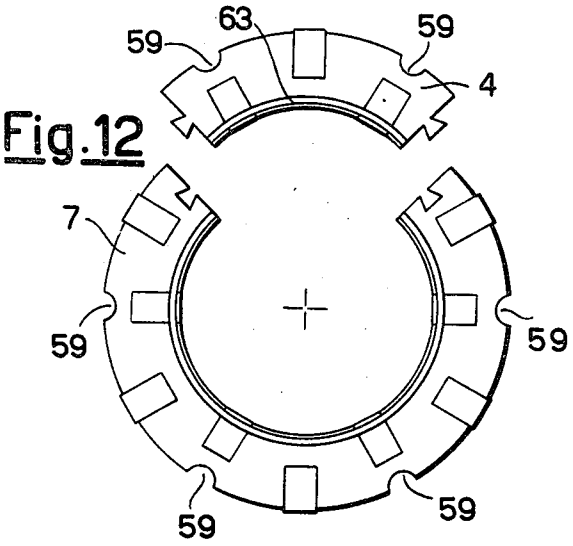
FIG. 12 is a view of the larger and narrower sectors of the bit-carrying disc.
Figure 11:
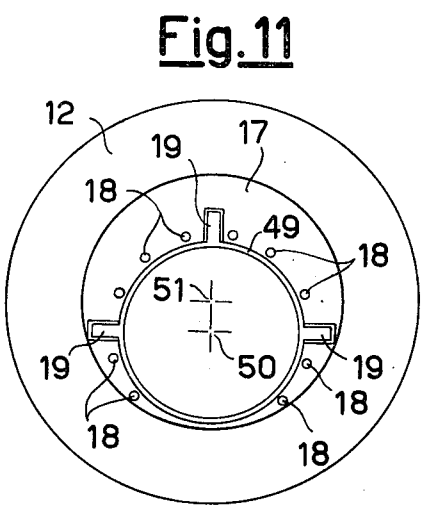
FIG. 11 is a diagrammatical showing of the bit-carrying disc eccentrically mounted on the pipeline and the shield with the ejectors and the guiding wheels for the apparatus.

The larger sector 2 of the mantle 11, in its turn, and through the pin 25 and the dovetail grooves 22 of FIG. 6, supports the larger sector 7 of the bit-carrying disc. The disc is thus rotated, in its turn, through 180 degrees together with the larger sector 2 of the mantle 11. At this stage, then, both the larger sector 2 of the mantle 11, and the larger sector 7 of the disc, which were initially in the inverted-U position, are now in the straight-U position so that the jack 8 is activated. The jack 8 which is placed on the fixed hood 5, moves longitudinally, from the left to the right as viewed in FIG. 5, and against the dovetailed grooves 9 shown in FIG. 7, and the narrower sector 3 of the mantle which supports, with the stop 26 of FIG. 5 and the grooves of FIG. 10, the narrower sector 4 of the bit-carrying disc 12. On completion of the stroke of the jack 8, as shown in FIG. 5, the narrower sector 3 of the mantle and the narrower sector 4 of the disc insert, as shown in FIG. 10, move the dovetail male portions 13 into the female portions until abutting the blind bottom of these as shown in FIG. 7. Simultaneously, the stop 24 of FIG. 5 snaps to lock the sector 3 on the hood 5. Then the abutments 25 and 26, through an automatic mechanism now shown herein become seated again and clear the bit-carrying disc 12 which is now complete, as viewed in FIG. 13. The mantle 11 is also complete and formed by the mantle sectors 2 and 3. The bit-carrying disc 12 is thus enabled to begin its rotations driven by the pinions 64 of the hydraulic motive means 30, one of which is shown in FIG. 5 as an inset in a ring gear incorporated in said disc.

FIG. 5 also shows, in dotted lines, one of the wheels 19 for supporting the apparatus 1 on the pipe 49 and moreover the passageways 59 located on the disc 12 for the digging debris, the shield 63 incorporated in the disc 12 which protects the pipe 49 from the digging debris and two of the bits 27 and 28 mounted on the disc 12, that is, the bit 27 of the outer set and the bit 28 of the inner set, which define the outline of the digging cross-section 58 in the motion towards the right of the machine 1 as viewed in FIG. 5.

In addition, in FIG. 5, the debris-suction tube 52, paired with another placed on the opposite side of the pipe 49, sucks through the ejector 53 the debris of the digging as it comes through the passageways 59 from the bits mounted on the disc 12 and ejects it through the outlet 55. In addition, there is shown in dotted lines on a carrying axle 31, either slider 32 on which is pivoted the bridge 34. The latter, when the clamps 41 and 39 are tightened on the pipe 49 by the movable arms 42 and the wheels 45 through the torsion bar 46, is compelled to take together with the remaining part of the machine, the transverse trim which appertains to it during the advance motion of the machine. This is due to the action of the transverse jack 40 as anchored to the guide 35 of the bridge, as shown in FIG. 17, and driven by a mechanism connected to a conventional sensor, not shown herein, which is responsive to the shifts from the vertical line, in the cross-section of the machine, from the bridge 34.

In FIG. 5, there is shown one of the two jacks 48 for the longitudinal motion of the machine 1, which is anchored to one end of the axle 31 and on the other end is fastened to the bridge 34. At 38, moreover, is shown a stiffening ridge welded to the top clamp 39.

In FIG. 6, in addition to what has already been described in the preceding FIGURES, there is shown one of the ejectors 18 of the shield 17 which prevent the digging debris from entering the inner portion of the fixed hood 5.

FIG. 7 shows the narrower sector 3 of the mantle in readiness for being thrust, together with the narrower sector 4 of the disc, on the guideways 9 so as to complete the fixed mantle 11 on which the complete disc 12 is intended to rotate.

Figure 8:
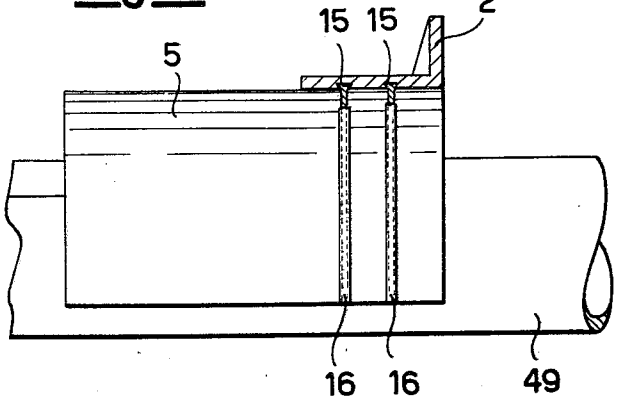
FIG. 8 shows in side view the hood of either pipe end.

In FIG. 8, the larger sector 2 of the mantle is shown, in cross-sectional view, before starting the rotary motion on the guideways 16 to take on the fixed hood 5 the inverted-U position.

FIGURES from 9 to 26 indicate in detail that which has been illustrated in the preceding drawings, whereas 51 indicates the center of the bit-carrying disc, 33 the pin of the bridge 34, 35 the guide of the bridge 34, and 36 and 37 are, respectively, the groove of the bridge 34 on which the male portion of the guide 35 of the bridge 34 is inserted. In addition, 43 indicates the pins of the movable clamps 41 which are actuated, for being approached to one another and to clear the pipe 49, by means of the hydraulic jacks 44. These drawings supplement the previous drawing FIGURES as described hereinbefore providing structural and functional details of the invention.

While the invention has been explained by a detailed description of certain specific embodiments, it is understood that various modifications and substitutions can be made in any of them within the scope of the appended claims which are intended also to include equivalents of such embodiments.

What we claim is:

1. An apparatus for digging a trench beneath a submerged pipeline comprising:

a pair of substantially parallel spaced carrying axles, a fixed hood mounted at each end to the carrying axles, said hood having a circular cross-section open in the bottom portion and having circumferential guideways of a dovetailed configuration and axial guideways of a dovetailed configuration, first hydraulic drive means, a mantle having a larger sector engaging the circumferential guideways and coupled to the drive means for rotation about the hood and a narrower sector mounted atop the hood in the axial guideways, hydraulic drive means mounted on the hood to drive the narrower mantle sector axially to form a closed loop with the larger sector surrounding the pipeline, said sectors having front circular guides of a dovetail configuration.

a disc engaging the front circular guides and having digging bits mounted thereon and a toothed portion thereabout.

hydraulic drive means having a pinion engaging the toothed portion of the disc for rotational motion cuasing the digging bits to engage the trench, clamping means mounted on an intermediate portion of the axles to mount the apparatus to the submerged pipeline, and, a compressed air reservoir coupled to the axles and maintaining the apparatus at the desired level for digging a trench beneath the submerged pipeline.

2. An apparatus according to claim 1 wherein the clamping means include:

a rotable semicircular bridge, a pair of sliders longitudinally moveable in guides formed in the carrying axles, said bridge being hinged at its ends in the slides, a jack coupled to the bridge for driving the bridge in a predetermined direction, a guide having the bridge connected thereto for rotatable motion, a vertical trim sensor connected to the jack to control the location of the bridge with respect to the pipeline, a top fixed clamp and four side clamps supported by said guide and extending downwardly to engage the pipeline, a pair of double-acting pistons coupled to and each operating two side clamps, a torsion bar connected to an end of top clamp to tighten the apparatus on the pipeline, a rolling wheel connected to the other end of the torsion bar and resting against the surface of the submerged pipeline, and, a pair of jacks for advancing the apparatus connected at their ends respectively between the semicircular bridge and the carrying axles.

3. An apparatus according to claim 1 wherein:

the digging bits are mounted for rotation about two concentric circles of the front disc, the digging bits on the outermost circle being arranged to provide a front of action inclined towards the axis of the front disc and the other bits being arranged vertically relative to said axis.

4. A method for digging a trench beneath a submerged pipeline with a digging apparatus comprising the steps of:

placing a pair of fixed hoods having an open circular cross-section and extending beneath the apparatus about the pipeline, providing a two sector mantle coupled to each hood, said mantle having a two sector front disc with digging bits mounted thereabout, rotating a sector of the mantle together with a sector of the front disc having drilling bits mounted thereon through 180° from a top position to a bottom position with respect to the pipeline, moving a narrower sector of the mantle and the disc forward to complete the larger sectors about the pipeline, rotating the completed front disc about the pipeline so that the bits perform a digging operation, providing a set of clamps rearside on the apparatus with respect to the direction of digging and tightening said clamps against the pipeline, advancing the digging apparatus along the pipeline with the clamps initially tightened against the pipeline and then relocating the clamps to an advanced position, sensing the vertical position of the apparatus for stabilizing purposes, and, moving the apparatus with respect to the pipeline in accordance with the sensed position.

5. A method in accordance with claim 4 further including the step of:

reversing the direction of the digging apparatus to perform a digging operation in the reverse direction.

* * * * *

UNITED STATES PATENT AND TRADEMARK OFFICE

CERTIFICATE OF CORRECTION

PATENT NO. : 4,149,326

DATED : April 17, 1979

INVENTOR(S) : Giovanni Rosa, et al.

It is certified that error appears in the above-identified patent and that said Letters Patent are hereby corrected as shown below:

First page, In the Abstract, line 1, after "apparatus" insert --and method--.

Col. 1, line 7, after "stabilized" insert --and--.

line 18, before "ships" delete "dragging" and insert --dragging-- after "ships".

line 20, before "steps" insert --the--.

line 66, correct "load" to read --loads--.

Col. 2, line 20, before "either" insert --engines--.

line 29, after "acquire" delete --with facility--.

line 44, correct "outer" to read --other--.

line 51, correct "stable" to read --stabilizing--.

line 54, correct "of" (first occurrence) to read --on--.

line 67, after "Immediately" insert a comma --,--.

UNITED STATES PATENT AND TRADEMARK OFFICE

CERTIFICATE OF CORRECTION

PATENT NO. : 4,149,326

DATED : April 17, 1979

INVENTOR(S) : Giovanni Rosa, et al.

It is certified that error appears in the above-identified patent and that said Letters Patent are hereby corrected as shown below:

Col. 3, line 4, delete "the" (first occurrence) and insert --a--.

line 9, correct "axes" to read -- axles -- line 28, correct "stabilizing purpose" to read --stabilization purposes--.

Col. 4, line 45, after "clamps" insert --is--.

Col. 5, line 22, after "Alternatively" insert a comma --,--.

Col. 6, line 15, after "3b" insert a comma --,--.

line 60, delete "section" and insert --sector--.

Col. 7, line 8, after "7" delete the comma --,--.

line 19, correct "now" to read --not--.

line 59, delete "other" and insert --outer--.

UNITED STATES PATENT AND TRADEMARK OFFICE

CERTIFICATE OF CORRECTION

PATENT NO. : 4,149,326

DATED : April 17, 1979

INVENTOR(S) : Giovanni Rosa, et al.

It is certified that error appears in the above-identified patent and that said Letters Patent are hereby corrected as shown below:

Col. 8, lines 15-16, after "actuated" delete ", for being approached to" and insert --to approach--.

line 46, after "configuration" delete the period "." and insert a comma --,--.

line 49, after "thereabout" delete the period "." and insert a comma --,--.

Signed and Sealed this

*Twenty-fifth* Day of *December 1979*

[SEAL]

*Attest:*

SIDNEY A. DIAMOND

*Attesting Officer* *Commissioner of Patents and Trademarks*